US006702111B2

(12) United States Patent
Ueno

(10) Patent No.: US 6,702,111 B2
(45) Date of Patent: Mar. 9, 2004

(54) IRON GOLF CLUB HEAD PROTECTOR

(76) Inventor: Shinzo Ueno, 681-5, Narazaki, Kikugawa-cho, Toyoura-gun, Yamaguchi 750-0322 (JP)

( * ) Notice: Subject to any disclaimer, the term of this patent is extended or adjusted under 35 U.S.C. 154(b) by 0 days.

(21) Appl. No.: 10/314,941

(22) Filed: Dec. 10, 2002

(65) Prior Publication Data

US 2003/0116456 A1 Jun. 26, 2003

(30) Foreign Application Priority Data

Dec. 20, 2001 (JP) ..... 2001-387391

(51) Int. Cl.[7] ..... A63B 55/00

(52) U.S. Cl. ..... 206/315.3; 206/315.6; 211/70.2

(58) Field of Search ..... 206/315.3, 315.6, 206/315.2; 211/70.2

(56) References Cited

U.S. PATENT DOCUMENTS

| | | | | | |
|---|---|---|---|---|---|
| 1,437,349 | A | * | 11/1922 | Moore, Jr. | 206/315.6 |
| 1,442,906 | A | * | 1/1923 | Rawlings et al. | 206/315.6 X |
| 1,711,344 | A | * | 4/1929 | Evans | 206/15.6 |
| 1,849,610 | A | | 3/1932 | Boyce | |
| 2,023,792 | A | * | 12/1935 | Sampson | 206/315.6 |
| 2,879,819 | A | * | 3/1959 | Turnbull | 206/315.2 |
| 3,053,298 | A | * | 9/1962 | Stamp | 206/15.6 |
| 3,729,036 | A | | 4/1973 | McFadden | |
| 4,227,559 | A | * | 10/1980 | Stroman | 206/315.6 |
| 4,334,564 | A | * | 6/1982 | Clayton | 206/315.6 |
| 4,664,382 | A | * | 5/1987 | Palmer et al. | 206/315.6 X |
| 5,505,300 | A | * | 4/1996 | Joh | 206/315.6 |
| 5,573,112 | A | * | 11/1996 | Kim | 206/315.6 |
| 5,573,122 | A | | 11/1996 | Williams | |
| 5,806,675 | A | | 9/1998 | Kim | |
| 5,988,378 | A | * | 11/1999 | Bell, Jr. | 206/315.6 X |

FOREIGN PATENT DOCUMENTS

| | | |
|---|---|---|
| JP | 58-80273 | 5/1983 |
| JP | 5-173 | 1/1993 |
| JP | 5-33751 | 5/1993 |
| JP | 5-337224 | 12/1993 |
| JP | 10-508515 | 8/1998 |
| JP | 11-128423 | 5/1999 |

* cited by examiner

*Primary Examiner*—Tri M. Mai
(74) *Attorney, Agent, or Firm*—Snider & Associates; Ronald R. Snider

(57) ABSTRACT

A golf iron head protector including a tubular member of cylindrical or polygonal shape to be inserted into the golf bag, nine or ten pipes for holding the shafts of nine or ten golf irons, said nine or ten pipes being fixed to the outer surface of the tubular member so that the axes of the pipes are oriented in parallel with the axis of the tubular member, and being fixed to the outer surface of the tubular member at predetermined intervals so as to be disposed in an approximately ring-shape in plan view, and nine or ten band shaped head supports for supporting the nine or ten golf iron heads so as not to bring them into contact with each other by clamping the golf iron heads to the tubular members, said head supports being provided to portions of the outer surface of the tubular member located obliquely above the nine or ten pipes.

7 Claims, 9 Drawing Sheets

IRON GOLF CLUB HEAD PROTECTOR

RELATED APPLICATIONS

This application claims the priority of Japanese Patent Application No. 2001-387391, filed on Dec. 20, 2001, which is incorporated herein by reference.

BACKGROUND OF THE INVENTION

1. Field of the Invention

The present invention relates to a golf iron head protector for protecting a golf iron head, and more specifically, for protecting the face (the surface for hitting a ball) thereof.

2. Description of the Related Art

Generally, when a golf player plays holes, he or she carries a golf bag holding a set of golf clubs consisting of fourteen clubs on a cart. When moving around with the golf bag placed on the cart during a game (in this case, the golf bag is placed on the cart at a slant or horizontally in many cases), a number of club heads often come into contact with each other, thereby damaging their faces of the heads, which should be handled with care.

In such a case, the heads of golf clubs other than golf irons (e.g. woods) are protected to some extent by head covers (golf clubs other than golf irons are normally covered with head covers because they are equipped with head covers at the time of purchase in most cases, and because they are used less often during a game).

However, the heads of a set of nine or ten golf irons are not normally covered by head covers, and thus they often become seriously damaged upon contact with each other while being carried on the cart (it is normal for golf irons not to be protected by head covers because they are not equipped with head covers at the time of purchase in most cases, and because they are used many times during a game).

Conventionally, several devices for protecting the heads of the golf clubs in the golf bag from being damaged by contact with each other have been proposed. For example, the following proposals has been made.

(1) In Japanese Unexamined Patent Application Publication No. 5-337224, a golf bag including a cylinder for creating a cylindrical section in the golf bag, and partitions for dividing the space between the cylinder and the inner wall of the golf bag into several sections is proposed. However, according to that proposal, the shafts of the golf clubs are separated from each other by the cylinder and the partitions, but the heads of the golf clubs remain "free to move about and make contact with each other" above the partitions. Therefore, when they are being carried on the cart (the golf clubs are placed on the cart at a slant or horizontally in many cases while being carried on the cart), the heads of the respective golf clubs come into contact with each other, and hence become damaged by each other. As a consequence, the proposal in that publication cannot prevent the heads of the golf clubs from coming into contact with each other at all though it can prevent the shafts of the golf clubs from coming into contact with each other.

(2) In Japanese Unexamined Utility Model Application Publication No. 5-173, a golf bag including a bundle of a total of fourteen pipes for inserting the shafts of the golf clubs is proposed. However, according to the proposal in that publication, although the respective club shafts are separated from each other, the heads of the clubs remain free to move about and make contact with each other above the pipes. Therefore, when they are being carried in the golf bag placed on the cart (the golf clubs are placed on the cart at a slant or horizontally in many cases while being carried on the cart), the heads of the respective golf clubs come into contact, and hence become damaged by each other. As a consequence, the proposal in that publication cannot prevent the heads of the golf clubs from coming into contact with each other at all although it can prevent the shafts of the golf clubs from coming into contact with each other.

(3) Japanese Unexamined Patent Application Publication No. 11-128423 proposes a golf bag including five small club mouths provided at the upper opening of the golf bag for inserting the shafts of the respective golf irons, U-shaped head shields provided above the respective club mouths for placing the head of the respective golf irons therein, a club mouth for inserting a shaft of a putter, and a large-sized central mouth for inserting a plurality of shafts of the other clubs, wherein the "five U-shaped head shields" that correspond to the lengths of the respective golf irons are formed continuously from the "five club mouths" so that the five golf irons may be disposed from the longest one in sequence.

However, in the proposal in that publication, although the U-shaped head shields are provided above the club mouths for inserting the respective golf iron shafts, the heads of the respective golf irons remain free to swing and move about in the respective U-shaped head shields. Furthermore, since each U-shaped head shield is opened (has an opening) upward, when the golf bag is carried while being placed at a slant or horizontally in the cart, the heads of the respective golf irons are often displaced upward from the U-shaped head shields due to vibrations of the cart, which may cause the heads of the respective golf irons to become free to move about and make contact with each other above the respective U-shaped head shields.

Therefore, with the proposal in that publication, when the golf bag is carried while being placed at a slant or horizontally on the cart, the heads of the respective golf irons move upward from the U-shaped head shields and are consequently brought into contact with each other, thereby becoming damaged. Therefore, the proposal in that publication cannot prevent the faces of the golf iron heads from being brought into contact with each other and hence becoming damaged when the golf bag is carried while placed at a slant or horizontally on the cart.

In addition, the proposal in that publication only forms a plurality of club mouths as described above at the upper opening of the golf bag, while the lower portions of the shafts of the golf clubs (the portions located downward of the club mouths of the golf bag) remain free to move about and contact with each other. Therefore, according to the proposal in that publication, when carrying the golf bag on the cart (especially when the golf bag is placed at a slant or horizontally on the cart), there is a possibility that the lower portions of the shafts of the golf clubs may ride on top of one another or come into contact with each other, resulting in the shafts becoming bent.

Furthermore, in the proposal in that publication providing the mouths and the U-shaped head shields, when pulling out the club from the bag, the shaft or the grip of the each club may disadvantageously catch on the peripheral wall (partition wall) of the club mouth, and thus the golf clubs including the golf irons cannot be taken out from the club mouths easily.

In addition, according to the proposal in that publication, the five U-shaped head shields that match the lengths of the respective golf irons are formed continuously from the five club mouths so that the five golf irons may be disposed from the longest one in sequence (See claim 1 and reference numeral 8 in FIG. 1 in the publication). However, according to the proposal in that publication, since only five U-shaped head shields are disposed continuously so as to match the lengths of the respective clubs as described above, it is extremely difficult for the user to easily recognize a whole set of nine or ten golf irons in order of length at a glance and to know whether or not all of them are present, or which one of the iron clubs out of the whole set is absent.

(4) In Japanese Unexamined Utility Model Registration Application Publication No. 58-80273, a club case including a storage pipe through which the shaft of a single golf club can be inserted, and a U-shaped head storage for supporting the head thereof are proposed. However, in the proposal in that publication, the club case is formed of a storage pipe for storing a single club, and a plurality of club cases are stored in the golf bag separately from each other. Therefore, when the user tries to take out a desired club from the plurality of clubs stored in the golf bag, the user has to remove the club in a state in which each golf club catches on the storage pipe from the storage pipe. In other words, in order to take out and use a golf club from the golf bag, after having taken out both the desired club and the storage pipe together, the user then has to pull out the club from the storage pipe, which is quite troublesome for the user.

According to the U-shaped head storage in that publication, there is a problem in that it cannot accommodate all types of golf iron heads, which differ in loft angle, in lie angle, or in structure of rear surface. In order to make the U-shaped head storage accommodate all the types of golf iron heads, which differ in loft angle, in lie angle, or in structure of rear surface, the angle and size of the recess of the U-shaped head storage in which the head is clamped have to be increased. However, if doing so, the angle or the size of the U-shaped recess becomes too large (increased too much), and thus it cannot clamp the head adequately, and thus the head moves freely in the U-shaped recess.

(5) In Japanese Unexamined Utility Model Registration Application Publication No.5-33751, a band-shaped head cover is proposed, said cover including continuously formed bags in which the respective golf club heads are stored. However, since the proposal in that publication is to store the heads of a plurality of golf clubs in this continuously formed bags altogether, it is not practical for using during a game because it is troublesome to take out the required club and store the used club before and after each shot, respectively, if all the heads of the plurality of clubs are stored altogether. Therefore, the idea proposed in that publication cannot be used for the purpose of preventing the faces of the golf iron heads from becoming damaged by being brought into contact with each other when the golf bag is carried on the cart during a game at all.

SUMMARY OF THE INVENTION

In view of such problems in the related art, the objects of the present invention are to provide a golf iron head protector that (a) reliably prevents the shafts of the golf irons from being brought into contact with each other, resulting the shafts becoming bent, and the faces of the golf iron heads from being bought into contact with each other and hence being damaged when the golf bag is carried on a cart at a slant or horizontally during a game, (b) adequately supports all the types of the golf iron heads, which differ in loft angle, lie angle, or structure of rear surface, (c) enables the user to take out the desired golf iron easily from the golf bag during a game, and (d) enables the user to easily recognize whether or not all the nine or ten golf irons are present, and if not, which golf irons are missing at a glance.

In order to achieve the objects described above, the golf iron head protector of the invention includes a tubular member of cylindrical or polygonal shape to be inserted into a golf bag, nine or ten pipes for holding (containing) shafts of nine or ten golf irons respectively which is fixed to the outer surface of the tubular member so that the axes of the pipes are oriented in parallel with the axis of the tubular member, disposed at predetermined intervals and in an approximately ring-shape in plan view, and disposed in contact with the inner wall surface of the golf bag or in the vicinity of the inner wall surface thereof, and nine or ten band shaped head supports for supporting the nine or ten golf iron heads respectively so as to prevent the heads from being brought into contact with each other by clamping the golf iron heads to (on) the outer surface of the tubular member which are disposed on portions of the outer surface of the tubular member located obliquely above the nine or ten pipes.

Preferably, in the golf iron head protector of the invention, the head support is composed of elastic belt for pressing the golf iron head against the outer surface of the tubular member, one end of said head support is fixed to a portion of the tubular member located in the vicinity of the upper end of the pipe, and the other end of said head support is fixed to a portion of the tubular member located away from said one end by a predetermined distance and upward or obliquely upward from said one end.

Preferably, in the golf iron head protector of the invention, the head support includes a first belt having a fixed end fixed to a portion of the tubular member located in the vicinity of the upper end of the pipe and a free end being movable against the tubular member, a second belt having a fixed end fixed to a portion of the tubular member located away from the upper end of the pipe by a predetermined distance and upward or obliquely above the fixed end of the first belt and a free end being movable against the tubular member, and an engaging portion (a connecting section) for engaging the free ends of the first and the second belts.

Preferably, the engaging portion includes a first Velcro fastening provided on the free end of the first belt and a second Velcro fastening provided on the free end of the second belt and being capable of engaging the first Velcro fastening.

Preferably, in the golf iron head protector of the invention, the tubular member includes a partitioning member therein for holding the shafts and grips of the five or four golf clubs out of irons to be inserted therein separately from each other.

Preferably, in the iron golf club head protector of the invention, the nine or ten pipes are fixed to the outer surface of the tubular member so that the heights of the upper ends of the respective pipes each of which has different length from each other are decreasing from the longest pipe to the shorter pipes in sequence. In this case, the lower ends of the pipes are preferably disposed and fixed at the substantially same level. In this case, the upper end of the tubular member is inclined to the axial direction of the tubular member such that the upper end of the tubular member is corresponding to the heights of the upper ends of the pipes that varies according to the lengths of the pipes.

Preferably, in the golf iron head protector of the invention, a portion of the tubular member that the golf iron head comes into contact with or faces toward is covered with soft cloth such as felt.

BRIEF DESCRIPTION OF THE DRAWINGS

FIG. 3(*b*) is a side view of the same;

FIG. 7(*b*) is a side view of the same;

FIG. 8(*b*) is a side view of the same; and

DESCRIPTION OF THE PREFERRED EMBODIMENTS

Figure 1:
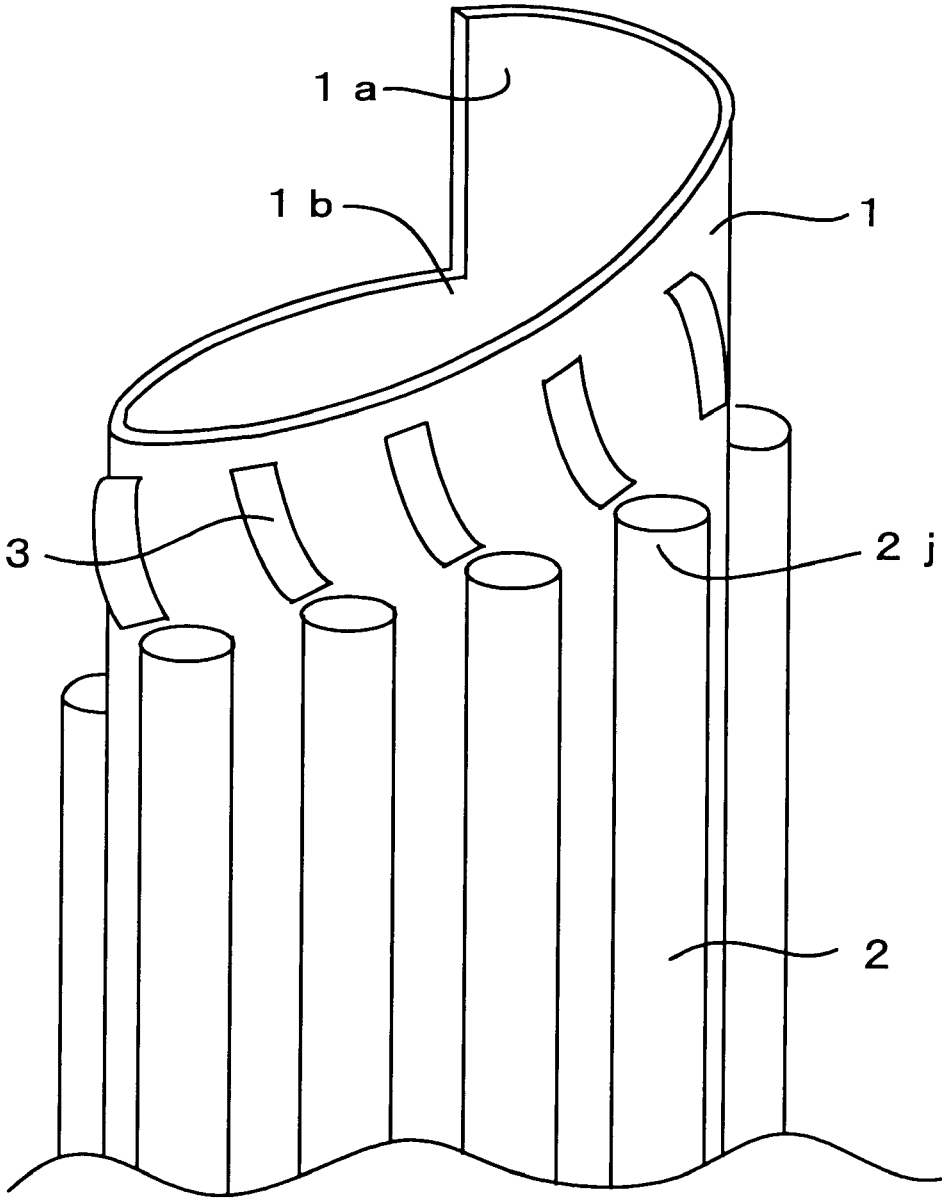
FIG. 1 is a perspective view illustrating a golf iron head protector according to a first embodiment of the invention.

A first embodiment of the invention will be described below. FIG. 1 is a perspective view showing a tubular member, pipes, and head supports according to the first embodiment. In FIG. 1, reference numeral 1 designates a plastic tubular member. The tubular member 1 is inserted into a golf bag (See reference number 30 in FIG. 6). Preferably, the tubular member 1 is fixed by a screw or the like to the golf bag. The tubular member 1 is formed into a tubular shape of about 13 to 14 cm in diameter, and of about 80 cm in height, such that it projects from the opening of the golf bag by about 5 to 20 cm when it is inserted into the golf bag (See FIG. 6). The tubular member 1 may be composed of a meshed or porous material.

As shown in FIG. 1, the upper end of the tubular member 1 is formed in such a manner that a portion 1*a* thereof is the highest, and another portion 1*b* that is in contact with the portion 1*a* is the lowest, and the portion between the portion 1*a* and the portion 1*b* is smoothly inclined against the axial direction of the tubular member 1.

Although it is not shown in FIG. 1, the outer peripheral surface of the upper portion of the tubular member 1 (the portion in the vicinity of and above the following upper ends 2*j* of pipes 2) is adhered with soft cloth such as felt for absorbing impact.

In FIG. 1, reference numeral 2 designates metallic or plastic pipes (nine pipes altogether) fixed to the outer peripheral surface of the tubular member 1 with screws or the like. The pipes 2 are fixed to the outer peripheral surface of the tubular member 1 at predetermined intervals so as to be disposed in an approximately ring-shape when viewed from the top. The pipes 2 may be composed of a meshed or porous material.

The user uses the pipes 2 for protecting the shafts of golf irons by inserting the grips and the shafts of the respective golf irons. Each of the pipes 2 is formed so as to have a diameter of about 3.2 cm.

Each of the pipes 2 is formed so as to have a length corresponding to each of the lengths of the nine golf irons that is different from each other, and such a length that only the head and near portion of the head of the each irons projects upwardly from the pipe 2 when the golf iron is inserted therein.

Therefore, when the user inserts the grips and the shafts of the golf irons in the respective pipes 2, the golf irons are stored in the pipes 2 in a state in which the heads project upward from the respective pipes 2.

Figure 3A:
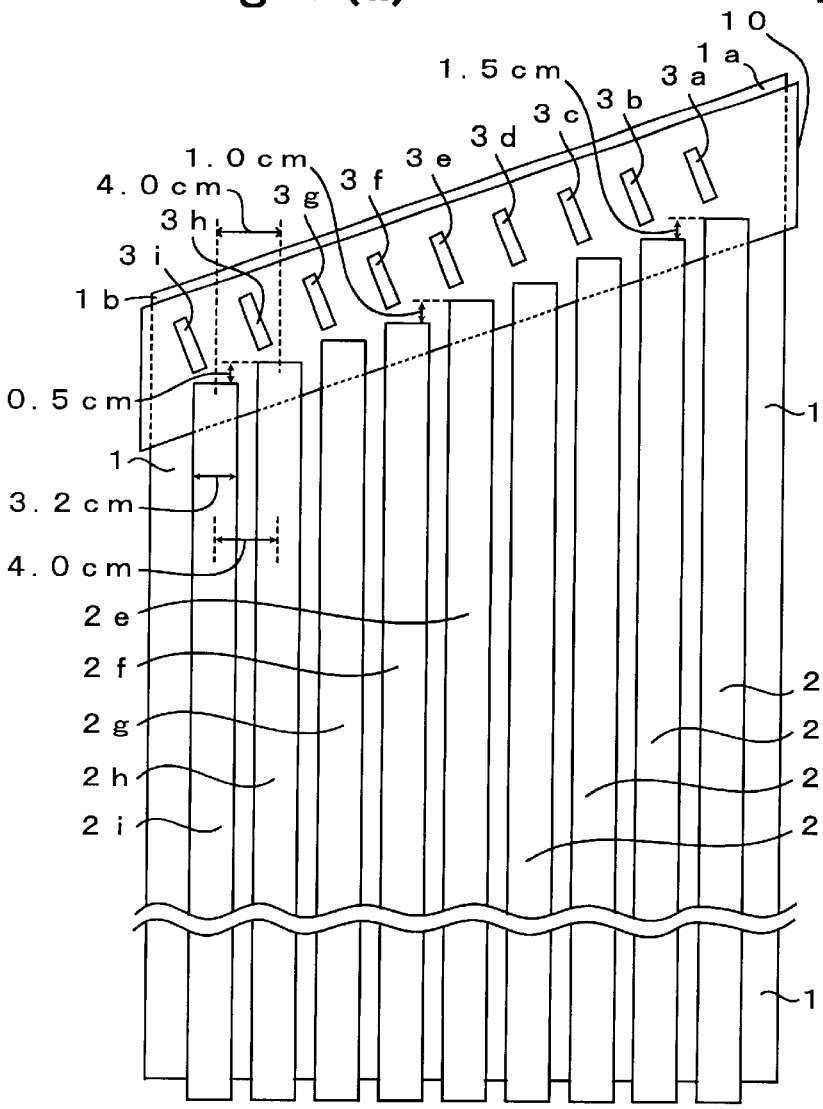
FIG. 3(*a*) is an unfolded plan view of a tubular member according to the first embodiment.
Figure 3B:
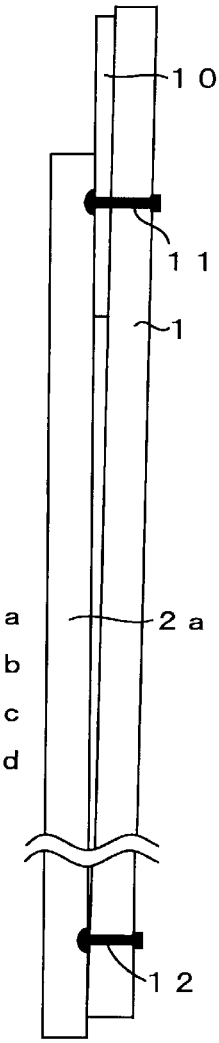

Although it is not shown in FIG. 1, the lower ends of the respective pipes 2 are fixed to the tubular member 1 so that they are positioned at the same level and abut to the inner bottom of the golf bag (See FIG. 3(*a*)). The upper ends 2*j* of the pipes 2 are positioned on the tubular member 1 at different heights corresponding to the lengths of the respective golf irons. The respective pipes 2 are disposed on the tubular member 1 in such a manner that the levels of the upper ends 2*j* thereof are gradually lowered in sequence from the longest pipe to the shortest pipe corresponding to the lengths of the respective pipes 2.

In other words, as shown in FIG. 3(*a*), the upper end of the pipe 2*a* to be fixed below the portion 1*a* of the tubular member 1 comes to the highest position, the upper end of the pipe 2*i* to be fixed below the portion 1*b* comes to the lowest position, and the upper ends of the remaining seven pipes 2*b*–2*h* to be fixed in-between are disposed so as to be lowered in sequence as the distance from the portion 1*a* increases.

In FIG. 1, reference numeral 3 designates a total of nine elastic belts fixed to the tubular member 1 and located obliquely above the upper ends 2*j* of the pipes 2 respectively. The elastic belts 3 are composed of rubber belts of several centimeters (8 cm for example) in length, and both ends thereof are fixed to the tubular member 1. More specifically, both ends of the elastic belt 3 are fixed by sewing or by Velcro fastening and the like to the soft cloth such as felt covering the outer peripheral surface of the upper portion of the tubular member 1.

The elastic belts 3 are fixed to the soft cloth of the outer surface of the tubular member 1 in such a manner that the lower ends thereof are located in the vicinities of the upper ends 2*j* of the respective pipes 2 and at the upper left positions of the upper ends 2*j* of the pipes 2 in the figure, and the upper ends thereof are located upwardly or obliquely above the upper ends 2*j* of the respective pipes 2 and away from the lower ends of the respective elastic belts 3 at a predetermined distance which is slightly longer than the width of a head 5*a*. In other words, in the first embodiment, the elastic belts 3 are disposed so as to extend from positions in the vicinities of the upper ends 2*j* of the respective pipes 2 to positions upward or obliquely upward from the upper ends 2*j*.

In the first embodiment, the elastic belts 3 are used for supporting the heads 5*a* of the golf irons 5 inserted into the respective pipes 2 by pressing (clamping) the heads 5*a* toward the felt (the soft cloth) on the tubular member 1.

Figure 2:
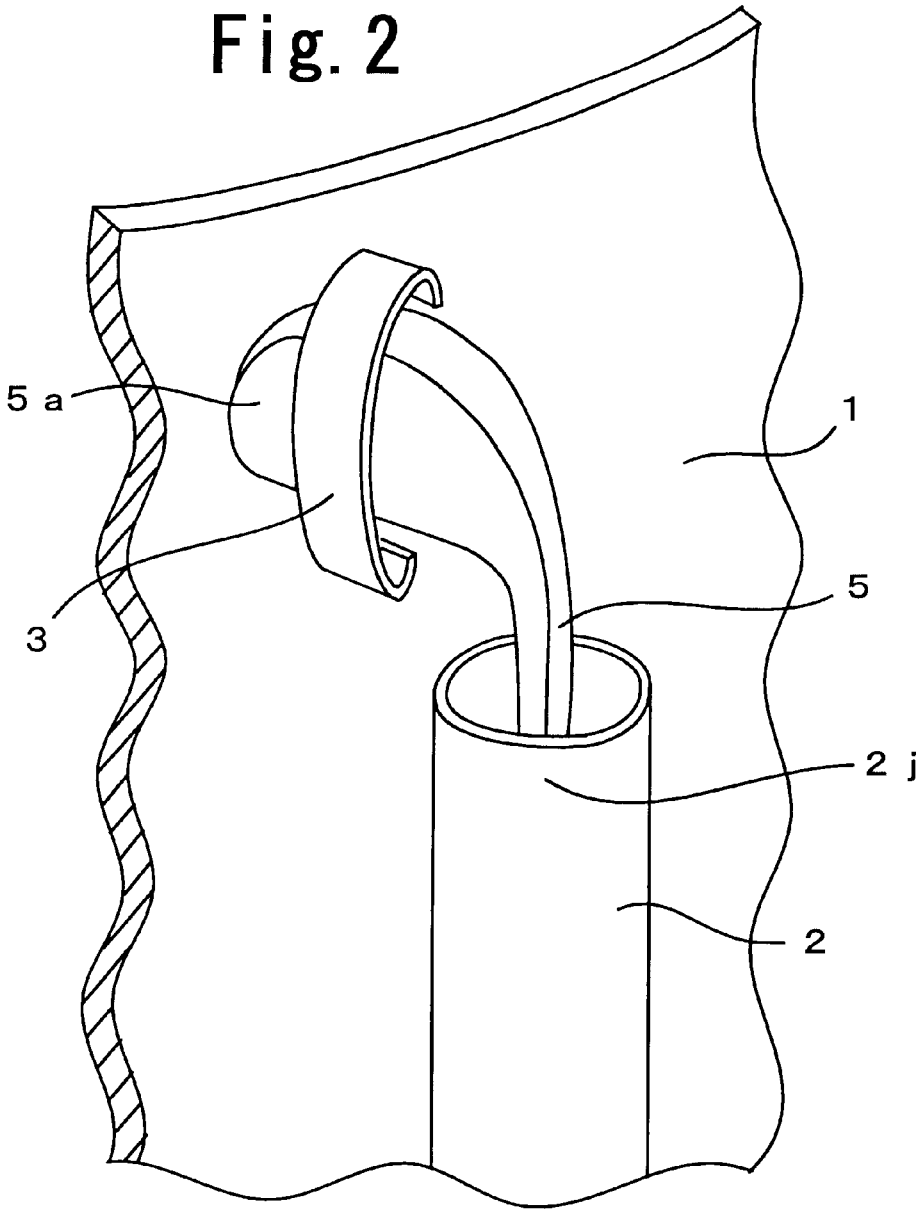
FIG. 2 is a perspective view showing how to use a elastic belt in the first embodiment.

In other words, as shown in FIG. 2, when the grip and the shaft of one of the golf irons 5 are inserted into the pipe 2, only the head 5*a* and its vicinity of the golf iron 5 projects upward from the pipe 2. In this state, the head 5*a* is free to rotate and free to move about and it is possible for it to come into contact with another heads 5*a*. Therefore, in the first embodiment, the user prevents the head 5*a* from moving freely by clamping the head 5*a* between the elastic belt 3 and the outer peripheral surface of the tubular member 1 as shown in FIG. 2. In FIG. 2 as well, the felt covering the outer peripheral surface of the tubular member 1 is not shown as in FIG. 1.

In the first embodiment, since the elastic belts 3 composed of rubber or the like are used as described above for pressing the heads 5*a* toward the outer peripheral surface of the tubular member 1, the heads of all the types of golf irons, which differ in loft angle, lie angle, and structure of rear surface may be adequately supported.

FIG. 3(*a*) is an unfolded plan view for explaining the tubular member 1, the pipe 2, and the elastic belt 3 that are in a state in which the tubular member 1 is unfolded. FIG. 3(*b*) is a side view of the same.

In FIG. 3(*a*), reference numeral 10 designates a felt fixed to an upper portion of the tubular member 1 adhered with adhesive agent or the like, reference numerals 2*a* to 2*i* designate the total of nine pipes fixed to the tubular member 1 with screws for example (See reference numerals 11 and 12 in FIG. 3(*b*)), and reference numerals 3*a* to 3*i* designate a total of nine elastic belts respectively having both ends fixed to the felt 10 on the tubular member 1 by sewing or some other means.

In the first embodiment, the total of nine pipes 2*a* to 2*i* are expected to accommodate, for example, a 4-iron, a 5-iron, a 6-iron, a 7-iron, an 8-iron, a 9-iron, a pitching wedge PW, a sand wedge SW and a lob wedge LA, respectively.

In the first embodiment, each pitch between the pipes 2*a* to 2*i* fixed on the tubular member 1 (distance between the axial centers of the respective pipes 2*a* to 2*i*) is set to be 4 cm for example. The respective pipes 2*a* to 2*i* are fixed on the tubular member 1 in such a manner that the levels of the upper ends thereof are lowered gradually in sequence from 2*a* to 2*i*. In other words, in the example shown in FIG. 3(*a*), the upper end of the pipe 2*b* is located lower than the upper end of the pipe 2*a* and the upper end of the pipe 2*c* is located lower than the upper end of the pipe 2*b* by 1.5 cm. The upper end of the pipe 2*d* is located lower than the upper end of the pipe 2*c*, the upper end of the pipe 2*e* is located lower than the upper end of the pipe 2*d*, the upper end of the pipe 2*f* is located lower than the upper end of the pipe 2*e*, and the upper end of the pipe 2*g* is located lower than the upper end of the pipe 2*f* by 1 cm. The upper end of the pipe 2*h* is located lower than the upper end of the pipe 2*g*, and the upper end of the pipe 2*i* is located lower than the upper end of the pipe 2*h* respectively by 0.5 c cm.

Figure 4:
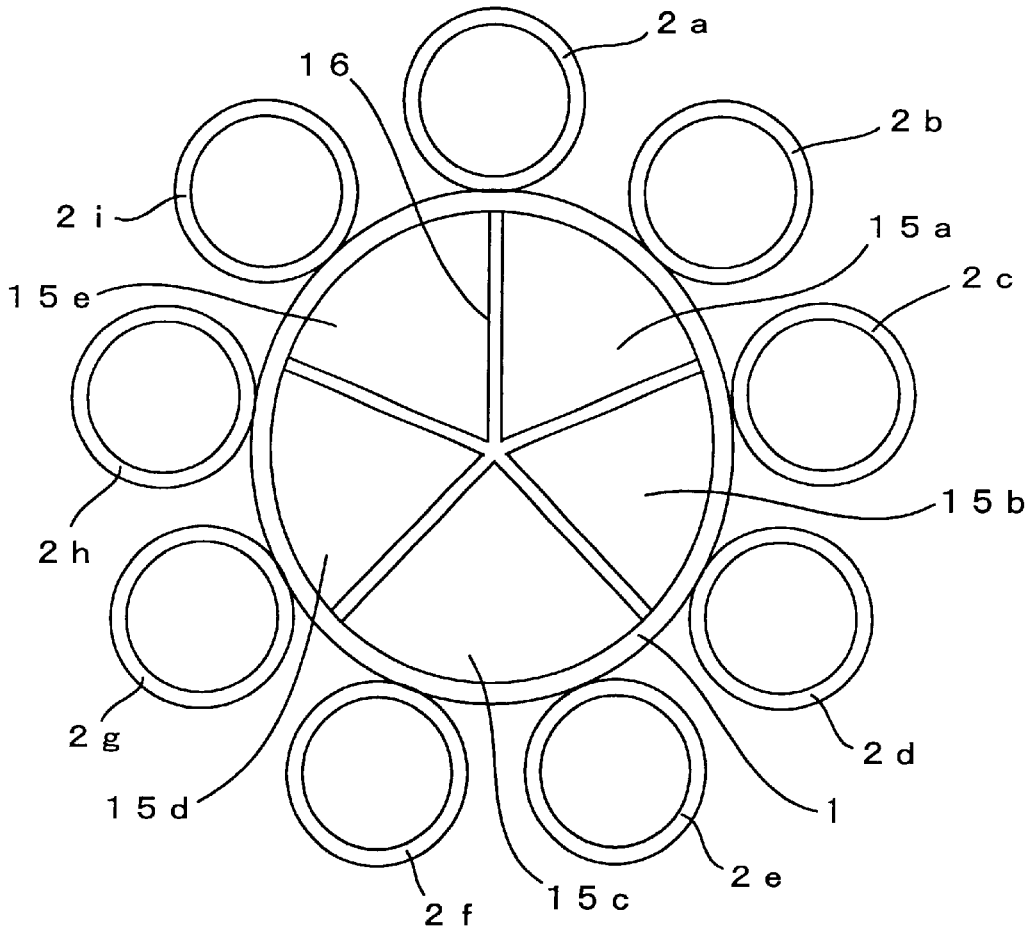
FIG. 4 is a plan view illustrating a partitioning member provided in the tubular member in the first embodiment.
Figure 5:
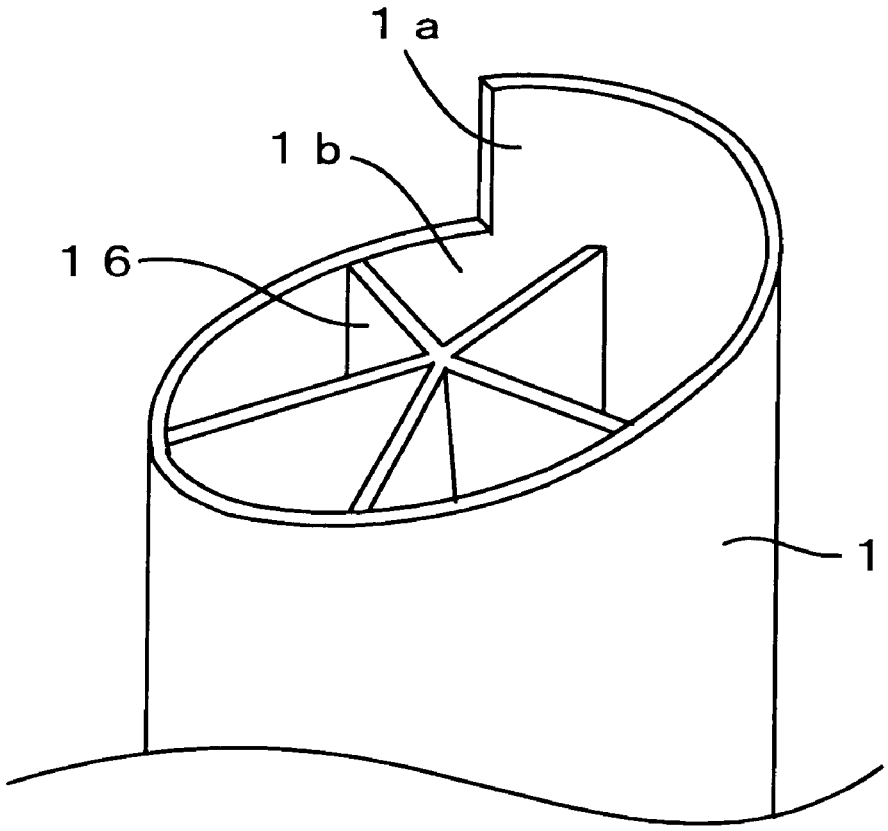
FIG. 5 is a perspective view illustrating the partitioning member provided in the tubular member in the first embodiment.

FIG. 4 is a plan view of the tubular member 1 according to the first embodiment when viewed from above, and FIG. 5 is a perspective view of the tubular member 1 when viewed obliquely from above. In the first embodiment, as shown in FIG. 4 and FIG. 5, a partitioning member (partitioning wall) 16 for forming a total of five sections 15*a*–15*e* is provided in the vicinity of the upper opening of the tubular member 1. The partitioning member 16 is composed for example of plastic and fixed to the upper portion of the inner wall surface of the tubular member 1 by means of screws or adhesion. In the first embodiment, the total of five sections 15*a*–15*e* formed by the partitioning member 16 are adapted to hold a total of five clubs except for the golf irons.

In the first embodiment, no special member is provided for supporting the heads of the respective clubs to be inserted in the sections 15*a*–15*e*. However, the five clubs other than the golf irons are generally provided with head covers for protecting the heads thereof, and thus it is quite rare that the heads of those five clubs come into contact with each other and become damaged.

In the first embodiment, soft cloth that can absorb impact, such as felt, is used to cover on and around the upper end of the partitioning member 16. Therefore, the shafts of the respective clubs are prevented from being damaged or being ungilted by contact with the partitioning member 16 when taking the club out and storing the club in one of the five sections 15*a*–15*e*.

Figure 6:
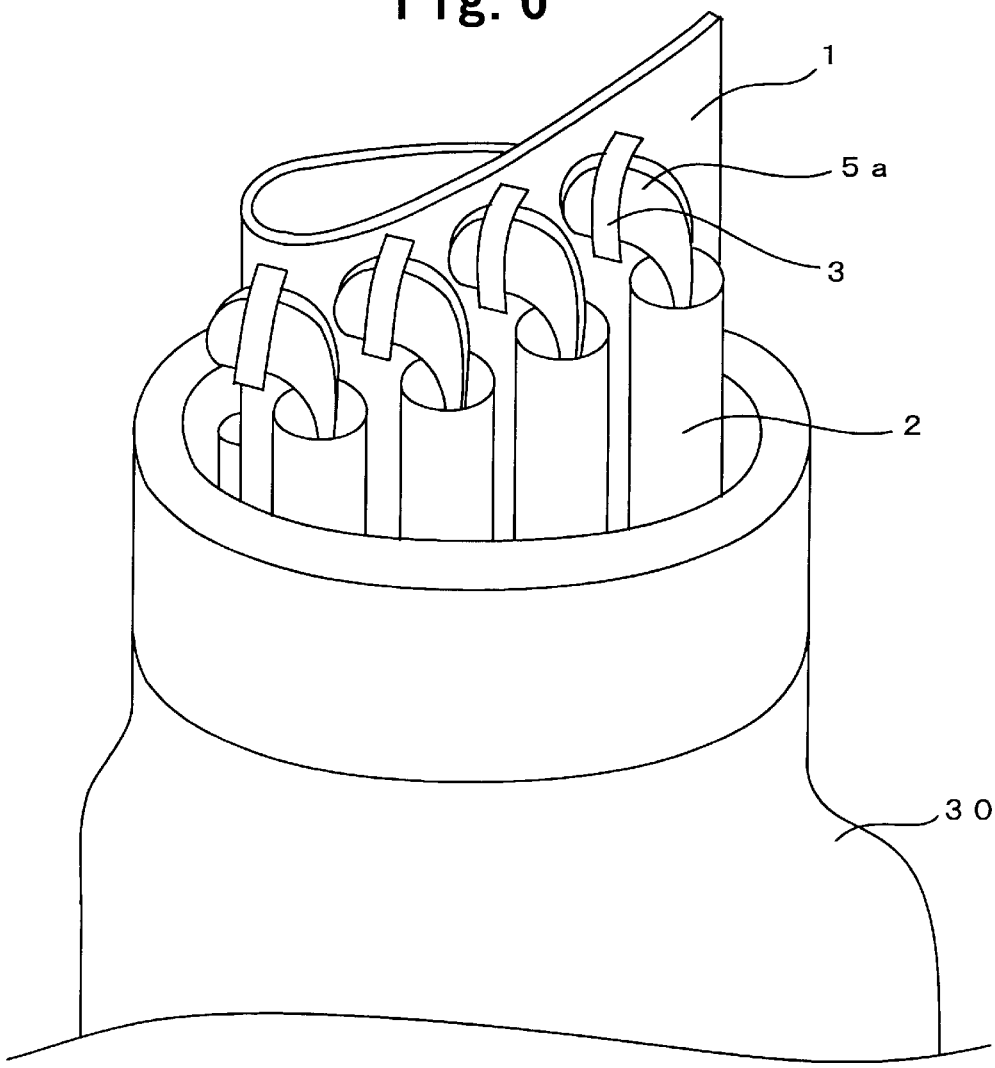
FIG. 6 is a perspective view illustrating the state during use according to the first embodiment.

In FIG. 6, reference numeral 30 designates a golf bag. In FIG. 6 as well, the felt covering the outer peripheral surface of the tubular member 1 is not shown in the figure as in the case of FIG. 1.

As described thus far, in the first embodiment, a total of nine golf iron shafts are inserted into the respective pipes 2, as shown in FIG. 6 showing the state during use, and the heads 5*a* of the respective golf irons projecting upward from the pipes 2 are supported by the elastic belts 3 so that they do not move freely.

Therefore, according to the first embodiment, damage to the heads 5*a* of the nine golf irons caused by their faces being brought into contact with each other in the golf bag 30 can reliably be prevented even when the golf bag 30 is carried on the cart at a slant or horizontally during a game.

In addition, according to the first embodiment, since the elastic belt 3 composed of rubber and the like is used, it can be applied to all the types of golf iron heads, which differ in loft angle, in lie angle, and in structure of rear surface, and thus the heads of all the types of golf irons may be adequately supported.

Furthermore, according to the first embodiment, since the grips and the shafts of the total of nine golf irons are inserted into the respective pipes 2, when the golf iron is taken out from the golf bag during a game, such inconvenience caused by the grip of the golf iron being caught by the partitioning wall of the golf bag, and thus making it hard to take out therefrom (the problem described in conjunction with Japanese Unexamined Patent Application Publication No. 11-128423 described in the Description of the Related Art) may be alleviated.

In addition, according to the first embodiment, since the pipes 2*a*–2*i* fixed on the outer peripheral surface of the tubular member 1 are disposed in an approximately ring-shape when viewed from the top, and in such a manner that the levels of the upper ends 2*j* are gradually lowered from the longest pipe 2*a* to the shorter pipes 2*b*, 2*c*, 2*d* . . . in sequence (the user inserts the golf iron into the pipe that matches the length of the golf iron) when viewed from the side or obliquely, the user can easily recognize at a glance whether or not all nine golf clubs are present, and if not, which golf irons are missing.

Figure 7A:
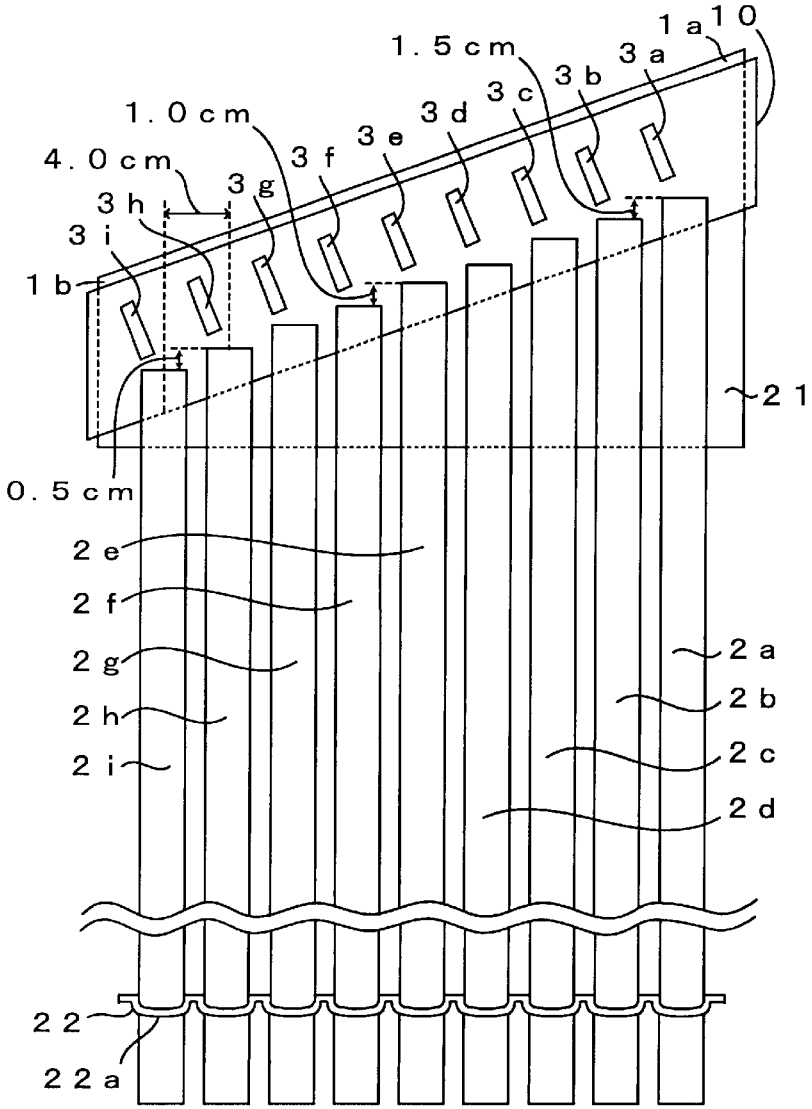
FIG. 7(*a*) is an unfolded plan view of the tubular member for illustrating a second embodiment of the invention.
Figure 7B:
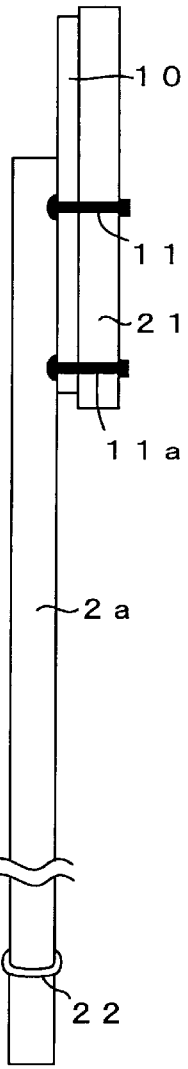

FIG. 7(*a*) is an unfolded plan view of a tubular member 1 for describing a second embodiment of the invention, FIG. 7(*b*) is a side view thereof. In the second embodiment, the upper portions of the total nine pipes 2*a*–2*i* are fixed on the outer peripheral surface of the plastic tubular member 21 so that they are disposed in an approximately ring-shape in plan view. As shown in FIG. 7(*b*), the upper portions of the pipes 2*a*–2*i* are fixed on the tubular member 21 by means of two screws 11, 11*a*.

The lower ends of the pipes 2*a*–2*i* are connected with each other in an approximately ring-shape in plan view by a joint section 22 formed by connecting the respective rings 22*a* around the pipes 2*a*–2*i* with each other.

The second embodiment is almost the same as the first embodiment other than the points described above. Therefore, according to the second embodiment, the same effects as in the first embodiment can be achieved.

Figure 8A:
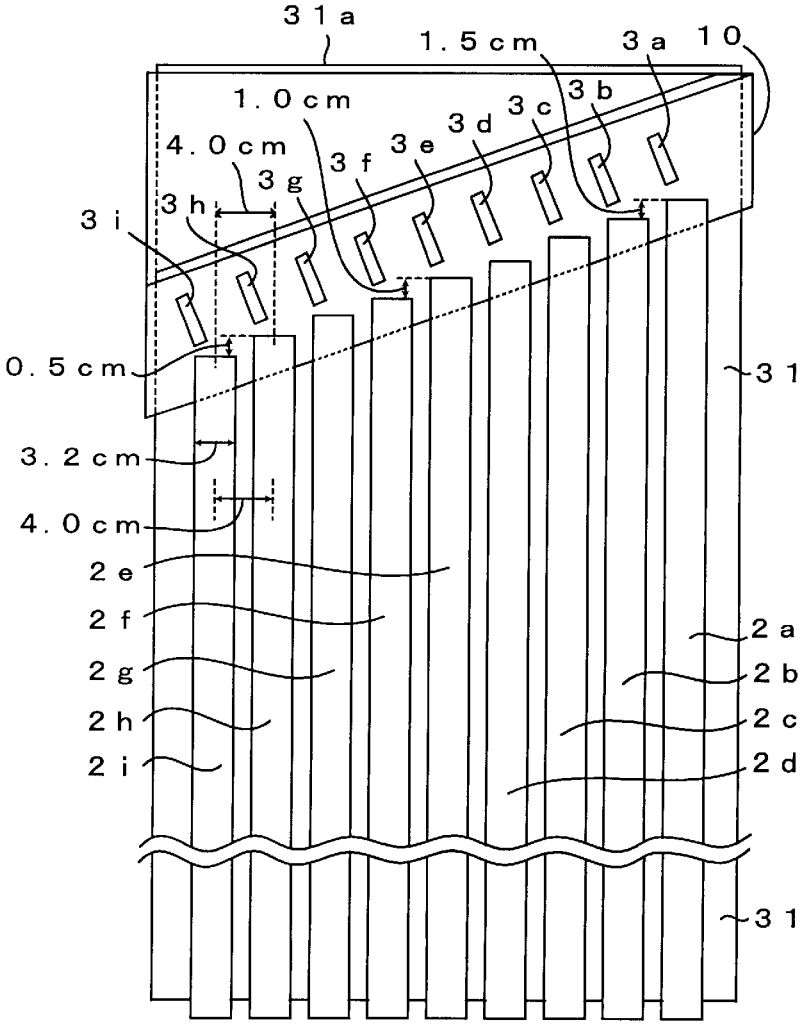
FIG. 8(*a*) is an unfolded plan view of the tubular member for illustrating a third embodiment of the invention.
Figure 8B:
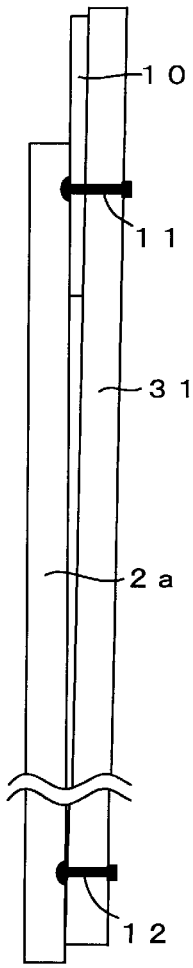

FIG. 8(*a*) is an unfolded plan of a tubular member 31 for describing a third embodiment of the invention, and FIG. 8(*b*) is a side view of the same. In the third embodiment, the pipes 2*a*–2*i* are fixed on the outer peripheral surface of the plastic tubular member 31 at predetermined intervals, and disposed in an approximately ring-shape in plan view. In the third embodiment, the tubular member 31 differs from the tubular member 1 in the first embodiment which has the upper end formed obliquely (See reference numeral 1 in FIG. 1), that is to say, an upper portion 31*a* thereof is formed so as to be approximately horizontal (the upper end 31*a* is entirely at almost the same level).

The construction of the third embodiment is almost the same as the first embodiment other then the points described above. Therefore, according to the third embodiment as well, almost the same effects as in the first embodiment are achieved.

Figure 9A:
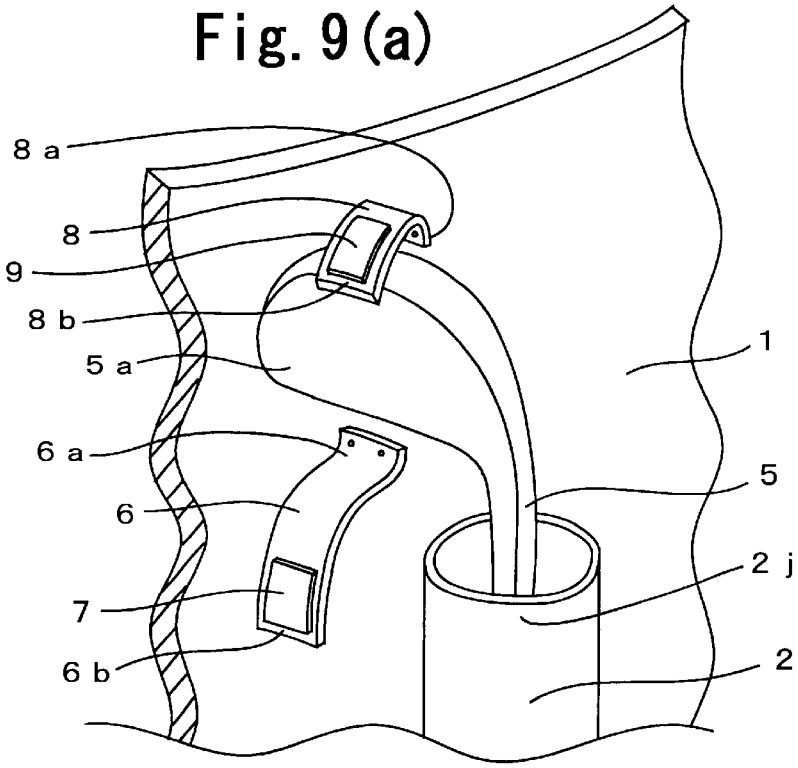
FIG. 9(*a*) and FIG. 9(*b*) are drawings illustrating a fourth embodiment of the invention.
Figure 9B:
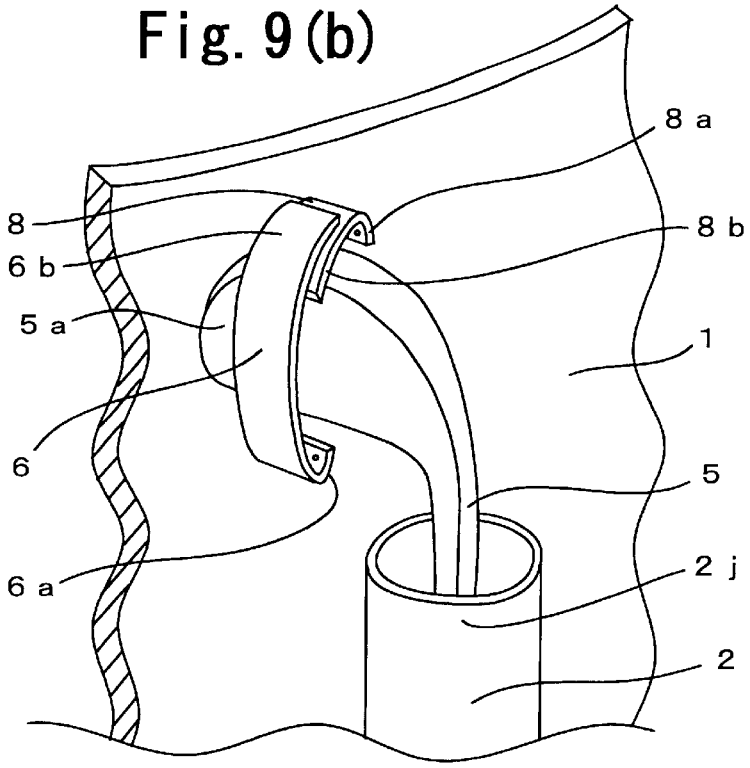

FIGS. 9A and 9B are drawings for describing a fourth embodiment. In the fourth embodiment, the head support for supporting the head 5*a* of the golf iron 5 is constructed from belts 6 and 8 provided with two Velcro fastenings.

In other words, in FIG. 9(*a*), reference numeral 6 is a belt having one end (fixed end) 6*a* fixed to a portion of the outer surface of the tubular member 1 located in the vicinity of the upper end 2*j* of the pipe 2 and obliquely above the upper end 2*j* of the pipe 2, and the other end (free end) 6*b* opened to the tubular member 1 so as to be free to move. On the free end 6*b* of the belt 6, Velcro fastening 7 including spiky hooks are provided.

In FIG. 9(*a*), reference numeral 8 is a belt having one end (fixed end) 8*a* fixed to a portion of the outer surface of the tubular member 1 located away from the fixed end 6*a* of the belt 6 by a predetermined distance which is slightly longer than the width of the head 5*a* and located above or obliquely above the upper end 2*j* of the pipe 2, and the other end (free end) 8*b* opened to the tubular member 1 so as to be free to move. On the free end 8*b* of the belt 8, Velcro fastening 9 including fuzzy loops are provided.

When the fourth embodiment is used during a game, the golf iron 5 is inserted in the pipe 2, then the belt 6 is disposed so as to face toward the head 5*a* of the golf iron 5, and then the Velcro fastening 7 on the free end 6*b* of the belt 6 is attached to the Velcro fastening 9 on the free end 8*b* of the belt 8 to join the belt 6 and the belt 8 as shown in FIG. 9(*b*). By joining the belt 6 and the belt 8, the head 5*a* of the golf iron 5 is clamped between the two belts 6 and 8 and the outer peripheral surface of the tubular member 1, so that it is supported so as to avoid contact with the heads of other golf irons.

In the fourth embodiment, a part or the entire part of the belt 6 (or a part or the entire part of the belt 8) may be composed of a elastic body (material) such as rubber. In this case, the head 5*a* is supported in the state of being pressed toward the outer surface of the tubular member 1 by the part (portion) composed of the elastic body when the head 5*a* is supported by the belts 6 and 8, and thus the head 5*a* is supported by the two belts 6 and 8 more stably.

Although various embodiments have been explained thus far, the present invention is not limited thereto, and various modifications are possible. For example, in the embodiments described above, the number of pipes 2 is nine in total, but ten pipes in total may be used in the invention, in the case where a player uses ten golf irons instead of nine.

In the embodiments described above, the pipe 2 is formed into a cylindrical shape. However, in the invention, the pipe must simply be of a shape in which the grip and the shaft of the golf iron may be inserted, and thus it may be a "polygonal tube" having a polygonal (square, pentagon, hexagon, and so on) cross section when taken along the horizontal plane. The metallic or plastic plate for forming the pipe 2 may be composed of a meshed or porous material.

In the embodiments described above, the tubular member 1 is formed into a cylindrical shape. However, the tubular member must simply be a member that can hold and fix the pipes 2 at predetermined intervals so as to be disposed in an approximately ring-shape in plan view, and thus it may be a polygonal tube having a polygonal (pentagon, hexagon, and so on) cross section when taken along the horizontal plane. The plastic or metallic plate forming the tubular member 1 may be composed of a meshed or porous material.

In the embodiments described above, the elastic belt 3 is disposed at the upper left position of the upper end 2*j* of the pipe 2 as shown in FIG. 1. However, it is devised as such for protecting the faces of right-handed golf iron heads (for allowing the faces of the right-handed golf iron heads to face toward and make contact with the soft felt on the tubular member 1). In the invention, the elastic belt 3 may be disposed at the upper right position of the upper end 2*j* of the pipe 2 in the figure for protecting the faces of left-handed golf iron heads.

The lengths of the pipe 2 and the length of the tubular member 1 in the invention may be adjusted by cutting or some other measures to corresponding to the lengths of the club shafts that the user has purchased. The adjustment of the length by cutting or some other measures may be performed at the factory that manufactures the golf iron head protector of the invention, at the sales agent selling the manufactured products, or by the user after purchase.

Generally the diameter of the aperture (club storage section) of the golf bag is 8 inches, 8.5 inches, or 9 inches. Therefore, the diameter of the tubular member 1 of the invention may be preferably adjusted depending on the diameter of the aperture of the golf bag (club storage section). The adjustment depending on the diameter of the aperture may be performed at the factory that manufactures the golf iron head protector of the invention, at the sales agent selling the manufactured products, or by the user after purchase.

In the invention, preferably, soft cloth that may absorb impact such as felt covers the vicinity of the upper end 2*j* of the pipe 2. In this case, the golf iron shaft may be prevented from being damaged or ungilted by contact with the upper end 2*j* of the pipe 2 when taking out the golf iron and storing in the golf bag.

Although the pipe 2 is fixed to the tubular member 1 by means of screws 11 and 12 in the first embodiment, the invention may employ various means other than screws, such as sewing or Velcro fastening for fixing the pipe 2 to the tubular member 1.

In the invention, after the four or five sections (See 15*a*–15*e* in FIG. 4) are formed by the partitioning member 16 in the tubular member 1, a pipe for inserting the golf clubs other than golf irons may be inserted into the respective sections and fixed to the inner wall surface of the tubular member 1 or the inner wall surface of the partitioning member. In such a case, such inconvenience caused by the grip of the golf club being caught by the partitioning member of the golf bag, and thus making it hard to take out therefrom may be alleviated.

Although the head support for supporting the golf iron head is constructed from a elastic belt (See reference numeral 3 in FIG. 1) or from a belt with Velcro fastening (See reference numerals 6 and 8 in FIG. 9) in the embodiments described above, the invention is not limited thereto.

In the invention, for example, a clip (a metallic or plastic member) may be provided as a head support instead of the elastic belt 3 in FIG. 1, said clip supporting the golf iron head by clamping the golf iron head to the outer surface of the tubular member 1, said clip being disposed in such a manner that the longitudinal direction thereof is oriented substantially parallel or obliquely to the axial direction of the tubular member, the upper end (fixed end as a fulcrum) of said clip being fixed to a portion of the tubular member 1 located obliquely above the pipe 2, and the lower end (free end) of said clip facing toward the golf iron head, being located downward from the upper end thereof and being pressed (urged) toward the outer surface of the tubular member 1 by a spring or the like so that the golf iron head is pressed by the lower end (free end) of the clip.

In the invention, for example, a clip (a metallic or plastic member) may be provided as a head support instead of the elastic belt 3 in FIG. 1, said clip supporting the golf iron head by clamping the golf iron head to the outer surface of the tubular member 1, said clip being disposed in such a manner that the longitudinal direction thereof is oriented substantially parallel or obliquely to the axial direction of the tubular member, the lower end (fixed end) of said clip being fixed as a fulcrum to a portion of the tubular member 1 located in the vicinity of the upper end 2*j* of the pipe 2 and obliquely above the upper end 2*j* of the pipe 2, and the upper end (free end) of said clip facing toward the golf iron head and being pressed toward the outer surface of the tubular member 1 by a spring or the like for pressing the golf iron head toward the outer surface of the tubular member 1.

In the invention, a clip (a metallic or plastic member) may be provided as a head support instead of the elastic belt 3 in FIG. 1, said clip supporting the golf iron head by clamping the golf iron head to the outer surface of the tubular member 1, said clip being disposed in such a manner that the longitudinal direction thereof is oriented substantially orthogonal to or obliquely to the axial direction of the tubular member, one end (fixed end as a fulcrum) of said clip being fixed to a portion of the tubular member 1 located on the left side or the right side of the head of the golf iron inserted into the pipe 2, and the other end (free end) of said clip facing toward the golf iron head and being pressed (urged) by a spring or the like so that the head of the golf iron is pressed by the other end (free end) toward the outer surface of the tubular member 1.

As described thus far, according to the golf iron head protector of the invention, the shafts of the total of nine or ten golf irons are inserted into the pipes and the golf iron heads projected upward from the pipes are supported so as not to move freely, in other words, so as not to be brought into contact with each other. Therefore, according to the invention, when moving around with the golf bag placed on the cart at a slant or horizontally (the golf bag is placed on the cart at a slant or horizontally in many cases), the inconvenience of nine or ten golf iron shafts coming into contact with each other and becoming bent as a consequence and the inconvenience of the nine or ten golf iron heads coming into contact with each other in the golf bag and thus the faces of the heads becoming damaged are reliably prevented.

In the invention, the head supports such as elastic belts of the invention are applicable to all the types of golf iron heads, which differ in loft angle, lie angle, and structure of rear surface, and thus all the types of golf iron heads may be reliably and adequately supported.

Since the golf iron heads are reliably supported by the head supports such as the elastic belts of the invention, even when the golf bag is carried at a slant or horizontally on the cart, the positions of the golf iron heads are retained without moving upward due to vibrations of the cart. Therefore, such a problem in that when the golf bag is carried at a slant or horizontally on the cart, the golf iron heads move upward the U-shaped head shields and, consequently, the heads are brought into contact with each other and thus become damaged due to vibrations of the cart as in the proposal in Japanese Unexamined Patent Application Publication No. 11-128423 described in the Description of the Related Art does not arise. Therefore, according to the invention, even when the golf bag is carried at a slant or horizontally on the cart, the golf iron heads are reliably prevented from being brought into contact with each other and thus their faces becoming damaged.

According to the invention, since the nine or ten golf irons are inserted in the pipes, when the golf iron is taken out from the golf bag during a game, such inconvenience caused by the grip of the golf iron being caught by the partitioning member (the partitioning wall), and thus making it hard to take out therefrom dose not arise.

In the invention, since nine or ten pipes for accommodating the golf irons are disposed in such a manner that the levels of the upper ends of the pipes are gradually lowered from the longest pipe to the shorter pipes in sequence, the user can easily recognize whether or not all the nine or ten golf irons are present, and if not, which golf irons are missing at a glance. Therefore, according to the invention, loss of the golf irons due to mislaying them during a game may be effectively prevented.

In the invention, since the upper end of the tubular member is formed obliquely against the axial direction of the tubular member corresponding to the heights of the upper ends of the pipes that vary according to the lengths of the golf irons to be inserted therein (or according to lengths of the pipes), the upper ends of the nine or ten pipes and the heads of the total nine or ten of golf irons projecting therefrom may be viewed as a whole even when the user looks at the golf bag obliquely, and thus the user can easily recognize whether or not all the nine or ten golf irons are present, and if not, which golf irons are missing at a glance (which golf irons have been lost due to mislaying them during a game).

Furthermore, in the invention, since soft cloth that can absorb the impact such as felt covers the portion of the tubular member 1 where the golf iron heads come in contact or are opposed, the faces of the golf iron heads come in contact with or oppose the soft cloth such as felt when the respective golf iron heads are supported by the head supports such as the elastic belts, and thus the faces of the golf iron heads are reliably protected.

What is claimed is:

1. A golf iron head protector comprising:

a tubular golf bag insert member of cylindrical or polygonal shape which is separate from a golf bag and insertable into a golf bag;

a plurality of pipes for holding shafts of golf irons, said plurality of pipes being fixed to the outer surface of the tubular member so that the axes of the pipes are oriented in parallel with the axis of the tubular member, being fixed to the outer surface of the tubular member at predetermined intervals so as to be disposed in an approximately ring-shape when viewed from the top, and being located in contact with an inner wall surface of the golf bag or in the vicinity of the inner wall surface thereof; and a plurality of band shaped head supports for supporting the plurality of golf iron heads so as to prevent the golf iron heads from being brought into contact with each other by clamping the golf iron heads on the outer surface of the tubular member, said head supports being provided to portions of the outer surface of the tubular member located obliquely above the plurality of pipes.

2. A golf iron head protector according to claim 1, wherein the band shaped head support is composed of a elastic belt having one end fixed to a portion of the tubular member which is located in the vicinity of the upper end of the pipe and obliquely upward from the upper end of the pipe, and the other end fixed to a portion of the tubular member which is located away from the one end of the head support by a predetermined distance and upward or obliquely upward from the one end of the head support.

3. A golf iron head protector according to claim 1, wherein the band shaped head support comprises:

a first belt having a fixed end fixed to a portion of the tubular member which is located in the vicinity of the upper end of the pipe and obliquely upward from the upper end of the pipe and a free end being movable to the tubular member, a second belt having a fixed end fixed to a portion of the tubular member which is located away from the fixed end of the first belt by a predetermined distance and upward or obliquely upward from the fixed end of the first belt and a free end being movable to the tubular member, and a connecting member for connecting the free end of the first belt and the free end of the second belt.

4. A golf iron head protector according to claim 1, wherein each of the plurality of pipes has a length corresponding to each of the lengths of the plurality of golf iron shafts which differ from each other.

5. A golf iron head protector according to claim 4, wherein each of the plurality of pipes has a length which is different from each other and the plurality of pipes are fixed to the outer surface of the tubular member so that the levels of the upper ends of the respective pipes decrease from the longest pipe to the shorter pipes in sequence.

6. A golf iron head protector according to claim 5, wherein the tubular member is formed in such a manner that the upper end thereof is inclined against the axial direction of the tubular member corresponding to the levels of the upper ends of the pipes that vary according to the lengths of the pipes.

7. A golf iron head protector according to claim 1, wherein a portion of the outer surface of the tubular member that the face of the golf iron head comes into contact with or faces toward is provided with a soft cloth that can absorb impact.

* * * * *